US005951787A

United States Patent [19]

Ohmi et al.

[11] Patent Number: 5,951,787

[45] Date of Patent: Sep. 14, 1999

[54] METHOD OF FORMING OXIDE-PASSIVATED FILM, FERRITE SYSTEM STAINLESS STEEL, FLUID FEED SYSTEM AND FLUID CONTACT COMPONENT

[75] Inventors: Tadahiro Ohmi, 1-17-301, Komegabukuro 2-chome, Aoba-ku, Sendai, Migaya-ken, 980; Shinji Miyoshi, Miyagi, both of Japan

[73] Assignee: Tadahiro Ohmi, Miyagi-ken, Japan

[21] Appl. No.: 08/666,312

[22] PCT Filed: Dec. 27, 1994

[86] PCT No.: PCT/JP94/02255

§ 371 Date: Oct. 15, 1996

§ 102(e) Date: Oct. 15, 1996

[87] PCT Pub. No.: WO95/18247

PCT Pub. Date: Jul. 6, 1995

[30] Foreign Application Priority Data

Dec. 30, 1993 [JP] Japan ..... 5-352928
Jun. 30, 1994 [JP] Japan ..... 6-150196

[51] Int. Cl.[6] ..... C23C 8/04

[52] U.S. Cl. ..... 148/280; 148/286; 420/34; 428/472.2

[58] Field of Search ..... 148/280, 286, 148/472.2; 420/34

[56] References Cited

U.S. PATENT DOCUMENTS 5,580,398 12/1996 Ohmi ..... 148/280
5,656,099 8/1997 Ohni ..... 148/280

FOREIGN PATENT DOCUMENTS 64-87760 3/1989 Japan .
1-180946 7/1989 Japan .
3-285049 12/1991 Japan .
4-183846 7/1992 Japan .
6-116632 4/1994 Japan .

*Primary Examiner*—David A. Simmons
*Assistant Examiner*—Robert R. Koehler
*Attorney, Agent, or Firm*—Randall J. Knuth

[57] ABSTRACT

A passive film forming method enabling formation of a passivated-oxide film having a layer made of chromium oxide in its outermost surface without conducting composite electric polishing. Also disclosed is a ultra-high purity fluid feed system, processing apparatus, and a fluid contracting component, each of which is free of metal contamination and is excellent in the gas discharge characteristics, non-catalytic characteristics and corrosion resistance. The surface of the ferrite-based stainless steel containing Mn by not more than 0.03 wt %, Cu by not more than 0.05 wt %, C by not more than 0.01 wt %, and Al by not more 0.01 wt % is electrolytically polished, then moisture is removed from the surface of the stainless steel by making the steel in an inert gas, then a passivated oxide film having a layer made of non-crystalline chromium oxide is formed on the outermost surface thereof by executing heat treatment in a temperature range of 300° C. to 600° C. in a mixture gas atmosphere of inert gas and 500 ppb to 2% $H_2O$ gas.

23 Claims, 5 Drawing Sheets

$Cr_2O_3$ PASSIVATIVE STATE
10% $H_2$ – 100ppm $H_2O$

MOISTURE DESORPTION CHARACTERISTICS
OUTER DIAMETER : 1/4" x 2m
FLOW RATE : Ar 1.2 l/min, 24°C 7.5rpm x 2rev. BEAD WIDTH 2mm 30rpm x 1rev. BEAD WIDTH 2mm

METHOD OF FORMING OXIDE-PASSIVATED FILM, FERRITE SYSTEM STAINLESS STEEL, FLUID FEED SYSTEM AND FLUID CONTACT COMPONENT

TECHNOLOGICAL FIELD

The present invention relates to a method of forming an oxide-passivated film, ferrite-based stainless steel, a fluid feed system, and a fluid contact component. More particularly, the present invention relates to a method of forming an oxide-passivated film having a layer made of amorphous chromium oxide on the outermost surface of the ferrite-based stainless steel, ferrite-based stainless steel on which the passivated film is formed, a fluid (gas, liquid) feed system using the ferrite-based stainless steel, and a fluid contact component having a contact section for contacting a fluid.

BACKGROUND ART

In a field of a semiconductor device, a magnetic material device, and a superconductor device, degree of integration has been becoming higher and higher, fine patterns each having a size of no greater than 1 $\mu$m are about to be mass-produced. Feeding an ultra-high purity gas is indispensable for forming fine patterns as described above, at present, and efforts has been made so that a density of impurity in the gas can be suppressed to not more than a couple of ppb, and furthermore to a couple of ppt.

On the other hand, a halogen-based corrosive gas represented by HBr and HCl or the like is often used, for instance, as a process gas for etching in semiconductor production. For this reason, a gas contact section has to be excellent also in corrosion resistance to prevent generation of any corrosive products due to contact with the gas.

The inventor has developed several types of the technology to satisfy the needs as described above, and one of them is the technology for forming a passivated film characterized in that a denatured layer which is formed by microcrystallization is formed on the surface of a stainless steel base material by means of composite electrolytic polishing, then, the surface is baked in an inert gas so as to remove moisture from the surface of the stainless steel, and then heat-treatment is carried out in temperature range from 450° C. to 600° C. in a mixed gas atmosphere of an inert gas and 500 ppb to 2% of $H_2O$ gas (Japanese Patent Application No. 266382/1992).

With this technology, it is possible to form an oxide-passivated film having a layer made of amorphous chromium oxide with a thickness of not less than 20 nm on the outermost surface. The stainless steel on which the passivated film is formed has a surface which not only shows excellent corrosion resistance to a highly corrosive gas, but also which a quantity of impurities containing mainly moisture and hydrocarbon deposited thereto is quite small, and even if some of the impurities is deposited thereto, the impurities can be removed from the surface with low energy. Furthermore, the surface is an extremely chemically stable one which does not show any catalytic effect to an active gas made of special ingredients such as $SiH_4$, $B_2H_6$. As a result, in a gas feed system in which piping is formed with the stainless steel, a gas in which a density of impurity is suppressed to a level of a couple of ppt can be fed to a process chamber.

However, the technology described above is generally used mainly for an austenite system SUS316L.

The surface of this passivated film not only has excellent corrosion resistance to the highly corrosive gas as described above, but also a quantity of impurities containing mainly moisture and hydrocarbon deposited thereon is quite small, and even if some of impurities are deposited thereon, the impurities can be removed therefrom with low energy. Furthermore, the surface is an extremely chemically stable one which does not show any catalytic effect to an active gas made of special ingredients such as $SiH_4$, $B_2H_6$.

By the way, in the technology for forming a passivated film, it is essential to form a fine denatured layer by using the technology of composite electrolytic polishing, buffing, or polishing with abrasive grains before heat-treatment is carried out to form the passivated film.

However, when composite electrolytic polishing is conducted on, for instance, the internal surface of a ¼-inch type of tubing, it is not always easy to conduct the polishing uniformly to the tubing, so that in some cases, the fine deformed layer may not be formed on some portions. For this reason, the passivated film having a layer made of chromium oxide can not be formed on the outermost surface of the portions even if heat-treatment for forming a passivated film is carried out. Also, workmanship in composite electrolytic polishing is difficult as compared to that in electrolytic polishing, so that experience is required.

An object of the present invention is to provide a method of forming a passivated film capable of forming an oxide-passivated film having a layer made of chromium oxide on the outermost surface without conducting composite electrolytic polishing.

Another object of the present invention is to provide an ultra-high purity fluid feed system, a process apparatus, and a fluid contact component, each of which uses steel having materials for ferrite-based stainless steel completely controlled, is free from metal contamination, and has excellent discharge gas characteristics, non-catalytic property, and high corrosion resistance.

DISCLOSURE OF THE INVENTION

The above problems can be solved with a method of forming an oxide-passivated film on ferrite-based stainless steel characterized in that the surface of ferrite system stainless steel is electrolytically polished, and then is baked in an inert gas so as to remove moisture from the surface of the stainless steel, and then heat-treatment is carried out in a temperature range from 300° C. to 600° C. in a mixed gas atmosphere of an inert gas and 500 ppb to 2% of $H_2O$ gas, whereby an oxide-passivated film having a layer made of amorphous chromium oxide is formed on the outermost surface thereof.

The stainless steel is preferable to be ferrite stainless steel containing Mn by not greater than 0.03 wt %, S by not greater than 0.001 wt %, Cu by not greater than 0.05 wt %, C by not greater than 0.01 wt %, and Al by not greater than 0.01 wt %.

The stainless steel is preferable to be ferrite stainless steel containing Mn by not greater than 0.03 wt %, S by not greater than 0.001 wt %, Cu by not greater than 0.05 wt %, C by not greater than 0.01 wt %, Al by not greater than 0.01 wt %, and Ni by 1.0 to 5.0 wt %.

FUNCTION

Description is made hereinafter for effects according to the present invention together with some knowledge obtained when the present invention was carried out.

The inventor devoted himself to the study for a technology capable of forming an oxide-passivated film having a layer made of chromium oxide on the outermost surface of a stainless steel only by conducting electrolytic polishing.

At first, a role of a denatured layer in the technology was fundamentally reexamined. The role of the denatured layer therein is assumed as follows. Namely, different from a case of electrolytic polishing, in a case of composite electrolytic polishing, the surface is mechanically polished, and with the polishing, cutting, plastic deforming, melting, and chemically changing are generated. For this reason, a chemically active so-called Bailby layer made of extremely fine crystal, namely a denatured layer is formed on the surface, and at the same time a plastic denatured layer is formed toward the internal section of the surface, and it can be considered that the existence of this Bailby layer has something to do with the formation of a layer made of only chromium oxide. Namely, diffusion of Cr generated along an extremely fine crystal boundary existing in the denatured layer is promoted, and in a weak acidity atmosphere, $Cr_2O_3$ is formed on the surface.

However, an idea that the role of the denatured layer would be specific to austenite system stainless steel came up to the inventor's mind.

The inventor tried to form a passivated film on ferrite-based stainless steel according to the idea.

Japanese Patent Application No. 285049/1991 is well known as a reference concerning ferrite stainless steel for a high-purity gas. In this reference, there is disclosed a pipe made of ferrite stainless steel for a high-purity gas characterized in that the pipe is made of ferrite stainless steel containing C by not greater than 0.03%, Si by not greater than 0.5%, Mn by not greater than 0.5%, P by not greater than 0.03%, S by less than 0.001%, Ni by not greater than 2.0%, Cr by 16 to 30%, O by not more than 0.05%, N by not more than 0.03%, Al by not more than 0.01%, and Mo by 0.1 to 3.5%, and the rest of the elements in the stainless steel actually comprise Fe, and internal roughness $R_{max}$ is not greater than 0.5 $\mu$m. Also description concerning Cr is disclosed therein as to which "a passivated film made of $Cr_2O_3$ is formed on the surface", and furthermore description of "an oxide-passivated coating may be generated by wet oxidation or dry oxidation after its smoothing" is also disclosed therein.

However, there is no disclosure in the publication on the technology for forming a passivated film having a layer made of only chromium oxide not containing therein iron oxide on the outermost surface.

The inventor electrolytically polished the internal surface of the pipe comprising the ferrite-based stainless steel having the composition described above (C: 0.015%, Si: 0.4%, Mn: 0.25%, P: 0.015%, S: 0.0008%, Ni: 0.1%, Cr: 18%, O: 0.02%, N: 0.015%, Al: 0.007%, Mo: 0.28%, the rest Fe), carried out baking of the surface, and heat-treatment thereto in a mixed gas atmosphere of an inert gas and 500 ppb to 2% of $H_2O$ gas for forming the passivated film thereon. Then, the pipe was welded so as to constitute a gas feed system. A HCl gas was flown into the gas feed system left as weld, and then generation of corrosion in the internal surface thereof was recognized.

For this reason, the inventor considered that the generation of corrosion would be caused by the composition of the stainless steel, and carried out some experiments by changing composition of each element, and as a result, the inventor found that each of Mn, Cu, C, and Al greatly effects to the generation thereof.

Namely, the inventor found out that these elements were splashed as fumes during the welding, the splashed elements were carried to a downstream of gas with a back shield gas generated during the welding, and were deposited on the surface, which caused the corrosion resistance to be degraded. In other words, when these elements are deposited on the surface, voltaic cells are formed between the elements and the metal of the substrate, and reaction due to the voltaic cells is locally generated, which results in the corrosion.

Then, the inventor investigated to which degree these elements should be suppressed while carrying out various types of experiments, and as a result, the inventor found out that, if Mn was suppressed to not more than 0.03 wt %, S to not more than 0.001 wt %, Cu to not more than 0.05 wt %, C to not more than 0.01 wt %, and Al to not more than 0.01 wt %, the corrosion resistance was remarkably improved even if the surface was left as weld, and fineness of the passivated film was also improved, which led to the present invention.

It should be noted that, in a case of ferrite-based stainless steel, there may be some reasons why an oxide-passivated film having a layer consisting of chromium oxide can be formed on the outermost surface not by conducting composite electrolytic polishing, but by conducting only electrolytic polishing, and the fact that the elements were controlled as described above can be one of the reasons. Furthermore, it can be considered that the result is provided because of the crystal structure. Namely, it is considered that the result is provided due to the fact that the austenite system has a face-centered cubic structure (fcc), while the ferrite system has a body-centered cubic structure (bcc). To be more specific, in a case of body-centered cubic structure, Cr is quite easily diffused, and a speed of the diffusion is conceivable to be 1000 times as faster as that in a case of face-centered cubic structure. Accordingly, it is considered that, in a case of ferrite system stainless steel, Cr can be diffused along the surface so as to form a chromium oxide layer on the outermost surface without artificially forming a deformed layer thereon.

EMBODIMENTS

Description is made hereinafter for embodiments of the present invention one by one according to the configuration requirements of the present invention.

Composition

The present invention aims at ferrite-based stainless steel. Especially, the ferrite-based stainless steel should contain Mn by not more than 0.03 wt %, S by not more than 0.001 wt %, Cu by not more than 0.05 wt %, C by not more than 0.01 wt %, and Al by not more than 0.01 wt %. Restriction of these elements to the composition range described above is indispensable to improve the corrosion resistance and to form a fine oxide-passivated film as described above.

Other essential elements include Cr, but the content is preferably in a range from 13 wt % to 35 wt %. However Mo may be contained therein to enhance the corrosion resistance.

Ni is avoided to be contained in the ferrite system stainless steel because of being an austenite generating element. However, in the present invention, Ni is preferably contained therein as far as a ferrite structure can be maintained. A quantity of Ni with which the ferrite structure can be maintained may be obtained through experiments, but it may be obtained with computation according to a Sheflar's structural view. Especially, in the present invention, Mn and C, each of which is other austenite generating element, are suppressed as less as possible, so that Ni may be contained depending on the content therein, but Ni by 1 to 5 wt % (preferably more than 2 wt % to not more than 5 wt %) may be contained therein.

In a case where Ni is contained therein, it is possible to form a fine oxide-passivated film having excellent corrosion resistance. Namely, in the method according to the present invention, it is desirable that hydrogen is added to an atmospheric gas in which heat-treatment is carried out. Because hydrogen contributes to reduction of iron oxide. Namely, hydrogen reduces iron oxide, but does not reduce chromium oxide. For this reason, in a case where hydrogen is added to the atmospheric gas, a fine chromium oxide passivated film can be formed. Then, in a case where Ni is contained therein, Ni on the surface of stainless steel polished to a mirror-smooth state (surface roughness: not more than $R_{max}$ 1 $\mu$m) works as a catalyst for decomposing a hydrogen gas into a hydrogen radical (H*). It becomes hydrogen. The hydrogen decomposed into the radical can reduce iron oxide much better, so that a layer only consisting of chromium oxide can more easily be formed.

Ni should be contained therein desirably by not less than 1 wt % to have the catalytic function on the surface of stainless steel. However, Ni is desirably contained by not more than 5 wt % because the surface may be changed to an austenite structure when it exceeds 5 wt %.

Electrolytic Polishing

In the present invention, electrolytic polishing is conducted. However, it is not required to form a denatured layer by composite electrolytic polishing. For this reason, it becomes possible to form without fail a passivated film having a layer made of chromium oxide on the outermost surface, for instance, even of the internal surface in a tube having a diameter smaller than ¼ inch.

Surface roughness obtained by electrolytic polishing should preferably be not more than $R_{max}$ 1 $\mu$m, more preferably be not more than 0.5 $\mu$m, and most preferably be not more than 0.1 $\mu$m.

Baking

In the present invention, the surface of stainless steel is electrolytically polished, and is baked in an inert gas so as to remove moisture therefrom. As temperature and time for baking they are not particularly restricted if the temperature is capable of removing the absorbed moisture therefrom, and the baking may be carried out, for instance, at least at 150° C. to 200° C. or in a higher temperature range from 400° C. to 500° C. However, in a case of ferrite system of stainless steel, brittle property occurs at 475° C., so that it is desirable that heating the surface up to this temperature should be avoided and baking is carried out at less than the temperature described above. It should be noted that the baking is preferably carried out in an inert gas (e.g. Ar gas, $N_2$ gas) containing moisture by not more than a couple of ppm of moisture (more desirable: not more than a couple of ppb).

An Atmosphere for Heat-treatment

Next, in a weak acidity atmosphere containing a mixed gas of an inert gas, and 500 ppb to 2% of $H_2O$ gas, heat-treatment is carried out at 300° C. to 600° C.

Or, in a weak acidity atmosphere containing a mixed gas of an inert gas, and 4 ppm to 1% of $H_2O$ gas, heat-treatment is carried out at 300° C. to 600° C.

As an inert gas, for instance, an argon gas or a nitrogen gas may be used.

$H_2O$ gas is set to a range from 500 ppb to 2%, but if it is less than 500 ppb, a layer made of only chromium oxide can not be formed on the surface, and the composition of surface is changed to a mixed composition of iron oxide and chromium oxide.

On the other hand, if $H_2O$ exceeds 2% in the composition, a porous passivated film containing iron oxide as its main element is formed thereon, which makes the corrosion resistance worse.

It should be notice that, to make a mixed gas atmosphere of an inert gas and 500 ppb to 2% $H_2O$ gas, generally, an inert gas and 500 ppb to 2% $H_2O$ gas are previously mixed so as to be fed to the surface of stainless steel to form a passivated film thereon, but a mixed gas of an inert gas, 250 ppb to 1% $H_2O$ gas, and 500 ppb to 2% hydrogen gas may be fed to the surface of stainless steel to form a passivated film thereon. In the latter case, Ni in the stainless steel works as a catalyst, and generates a hydrogen radical, and at the same time the hydrogen radical reacts with oxygen to generate $H_2O$, and a desired weak acidity atmosphere can be obtained.

Addition of Hydrogen Gas to the Atmosphere

It is desirable to add hydrogen by not more than 10% to the atmospheric gas described above. The effect of adding hydrogen gas thereto is described above. Namely, addition of hydrogen gas thereto has effects for reducing iron oxide. The effects are especially remarkable in the hydrogen changed to the radicals.

However, when content of hydrogen exceeds 10% in the atmosphere, fineness of the passivated film starts to be reduced, so that the content of not more than 10% is preferable. Also, the content of not less than 0.1 ppm is preferable. When hydrogen is contained by less than 0.1 ppm therein, the effects described above may not sufficiently be achieved.

Temperature

The temperature required for heat-treatment is in a range from 300° C. to 600° C. If the temperature is lower than 300° C., a thicker layer made of only chromium oxide can not be formed even if a period of time for heat-treatment is made longer. On the contrary, if the temperature exceeds 600° C., a layer containing iron oxide in its segregated state is formed on the surface, composition of the passivated film becomes nonuniform as a whole, and a passivated film having poor corrosion resistance is formed. It can be considered that this phenomenon occurs because, even if a quantity of C is suppressed, when the temperature exceeds 600° C., chromium carbide (e.g. $Cr_{23}C_6$) is precipitated in the base metal, and Cr is taken for the precipitation, so that non-uniformity is generated in composition of the passivated film. Also, when $Cr_{23}C_6$ is precipitated in a grain field, the grain boundary may easily be corroded, which is not desirable.

Period of Time for Heat Treatment

A period of time required for heat-treatment is preferably not less than 0.5 hour although it depends on also a temperature. A thickness of a layer made of chromium oxide increases in association with an increase of a period of time for heat-treatment.

Application

The ferrite-based stainless steel according to the present invention is preferably applicable to a component material for such equipment as a pipe, a process apparatus, a gas contact component (e.g. a diaphragm for a valve) or the like.

The ferrite-based stainless steel is preferably applicable not to a material for feeding gas, but to a material for feeding a liquid such as a chemical agent or ultra-pure water or the like. Because in the material made of stainless steel according to the present invention, metal atoms are hardly eluded therefrom to a chemical agent or the like, so that the chemical agent is not contaminated therewith.

It should be noted that the stainless steel according to the present invention shows remarkable characteristics especially in a case where it is used for a material to be welded. Namely, if description is made for a pipe as an example, in a case where pipes are welded to each other, an ultra-purity gas can be fed therethrough even if the pipes are left as weld. Because fumes of Mn or the like which cause the pipe to be corroded are seldom generated even if the welding is carried out there.

Furthermore, the ferrite-based stainless steel is characterized in that Cr composition therein does not show any change before and after the welding as compared to that in austenite system stainless steel even if the ferrite system stainless steel is placed adjacent to the welded section. Description is made for this point with reference to FIG. 4 and FIG. 5. FIG. 4 shows a case where the pipe is revolved once at 7.5 rpm and butt welding is carried out, and FIG. 5 shows a case where the pipe is revolved twice at 30 rpm and butt welding is carried out. Both of the figures show data obtained by measuring by means of ESCA a Cr density of the outermost surface inside the pipe from the welded section as a start point after the welding was carried out. In any of the cases described above, it is understood that, in a case of austenite system stainless steel, composition of Cr abruptly decreases near the welded section. On the contrary, in a case of ferrite-based stainless steel according to the present invention, that of Cr is not found to drop. For this reason, it is recognized that the ferrite-based stainless steel according to the present invention can maintain excellent corrosion resistance even after the weld has been carried out.

It should be noted that the process apparatus in the present invention covers a semiconductor manufacturing apparatus, a superconductive thin film manufacturing apparatus, a magnetic thin film manufacturing apparatus, a metallic thin film manufacturing apparatus, and a derivative thin film manufacturing apparatus, and in addition a film forming device and a process device for such as spatter, vacuum deposition, CVD, PCVD, MOCVD, MBE, dry etching, ion implantation, diffusion and reduction furnace, and also an evaluation device such as an Auger electron spectroscopy, a XPS, an SIMS, a RHEED, a TRXRF or the like. An ultra-pure water manufacture feed apparatus and a feed piping for the same are also included in the process apparatus of the present invention.

Also, as a fluid contact component, a main body or components constituting, for instance, a valve, a mass-flow controller, a connector, a filter, and a regulator or the like are included.

Preferable Method of Welding

As a method of welding, a method of welding, in which a heat gain to the weld section is set to not more than 600 joule/cm, is preferable. It is preferable to set a speed for welding to 20 cm/min, and also it is preferable to weld a section to be welded while a magnetic field having a vertical element is applied to the surface of the welded section. The magnetic field is preferably not less than 50 gauss. A width of weld bead is preferably not more than 1 mm. The method of welding disclosed in Japanese Patent Application No. 303681/1992 (Application: Nov. 13, 1992) described above may be applicable to the present invention as necessary.

BEST MODE FOR CARRYING OUT THE INVENTION

Description is made hereinafter for embodiments of the present invention. It should be noted that the present invention is not limited to the embodiments described below.

Embodiment 1

In the present embodiment, ferrite-based stainless steel containing Cr by 29.1 wt % is electrolytically polished. The surface roughness is assumed to be about 0.5 $\mu$m.

Table 1 shows composition of the stainless steel used in the embodiment.

TABLE 1

| Cr | Ni | Mo | C | N | Si | Mn | Fe |
|---|---|---|---|---|---|---|---|
| 29.1 | 2.10 | 3.90 | 0.005 | 0.013 | 0.10 | 0.05 | bal |

(wt %)

After electrolytically polished, the stainless steel is inserted into a furnace, the temperature in the furnace is raised from room temperature to 550° C. for 1 hour while an Ar gas having a density of impurity of not more than a couple of ppb is flown into the furnace, and the stainless steel is baked at the same temperature for 1 hour so as to remove the absorbed moisture therefrom. After the baking has been finished, the Ar gas is changed to a process gas having a density of hydrogen of 10% and a density of moisture of 100 ppm, and heat-treatment thereto is carried out for 3 hours.

Figure 1:
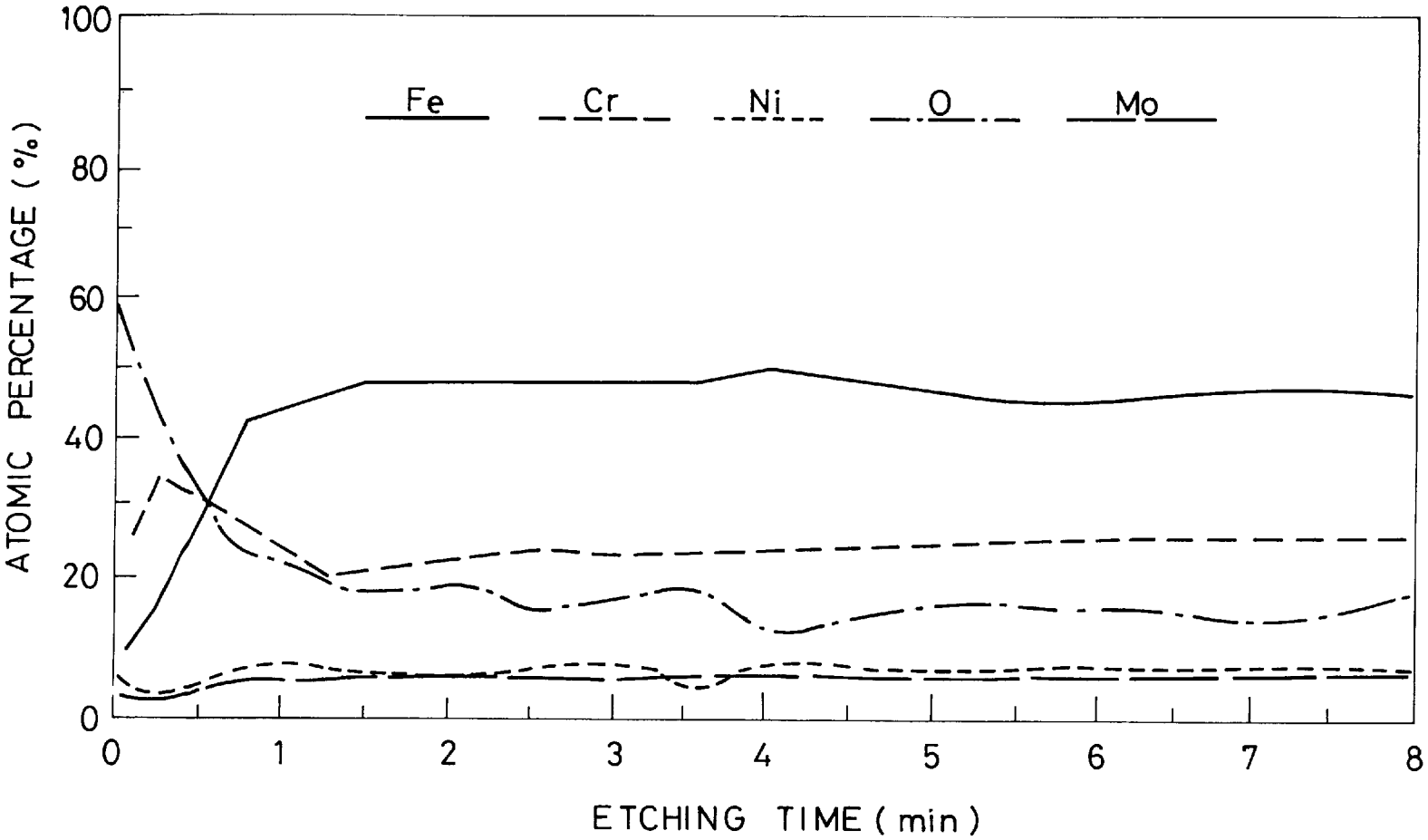
FIG. 1 is an XPS analysis view showing a state before formation of an oxide-passivated film in Embodiment 1.
Figure 2:
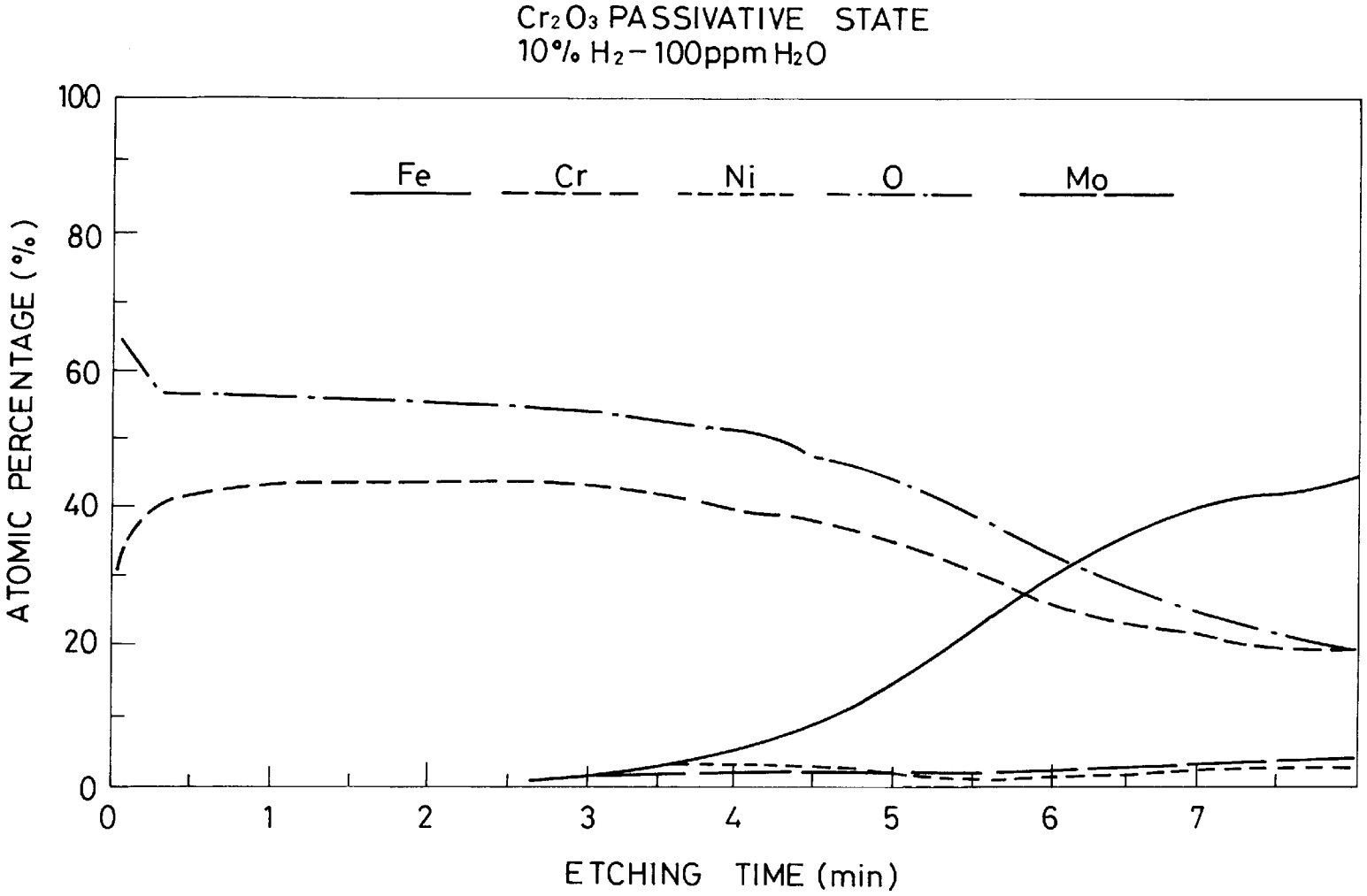
FIG. 2 is an XPS analysis view showing a state after formation of the an oxide-passivated film in Embodiment 1.

FIG. 1 shows an ESCA analysis view before the processing, and FIG. 2 shows an ESCA analysis view after the processing respectively.

As clearly understood from FIG. 1 and FIG. 2, 100% $Cr_2O_3$ is formed with a thickness of 15 nm in a direction of the depth on the outermost surface of the ferrite system passivated film formed under the conditions described above. Namely, it is understood that a passivated film having a layer made of 100 of $Cr_2O_3$ on the outermost surface can be formed on the surface of which the stainless steel has been electrolytically polished.

Embodiment 2

Evaluation of degasfication from moisture

Moisture desorption characteristics of a pipe in which the surface of the ferrite-based material electrolytically polished was subjected to a $Cr_2O_3$ processing was evaluated.

The method of evaluation was carried out according to the following procedure: a pipe having an outer diameter of ¼ inch and a length of 2 m is prepared, the pipe is exposed to the atmosphere for 24 hours so as to sufficiently have moisture contained in the air deposited on the internal surface of the pipe, and then an ultra-purity argon gas is fed from the upstream of the pipe, whereby a quantity of moisture desorbed from the internal surface thereof is measured. The measuring device was an atmospheric pressure ionized mass system (APIMS).

Figure 3:
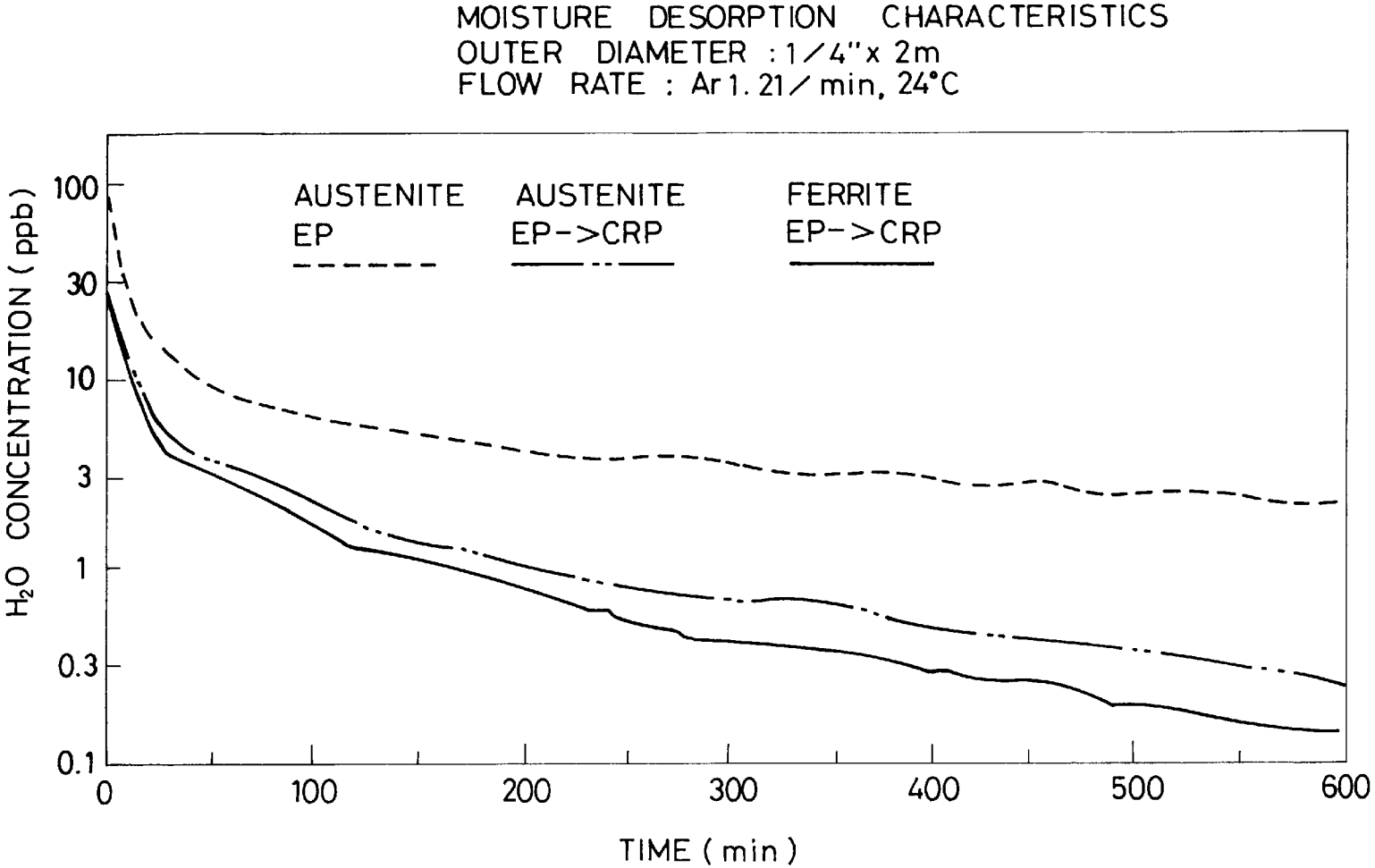
FIG. 3 is a graph showing a result of analysis of APIMS in Embodiment 2.
Figure 4:
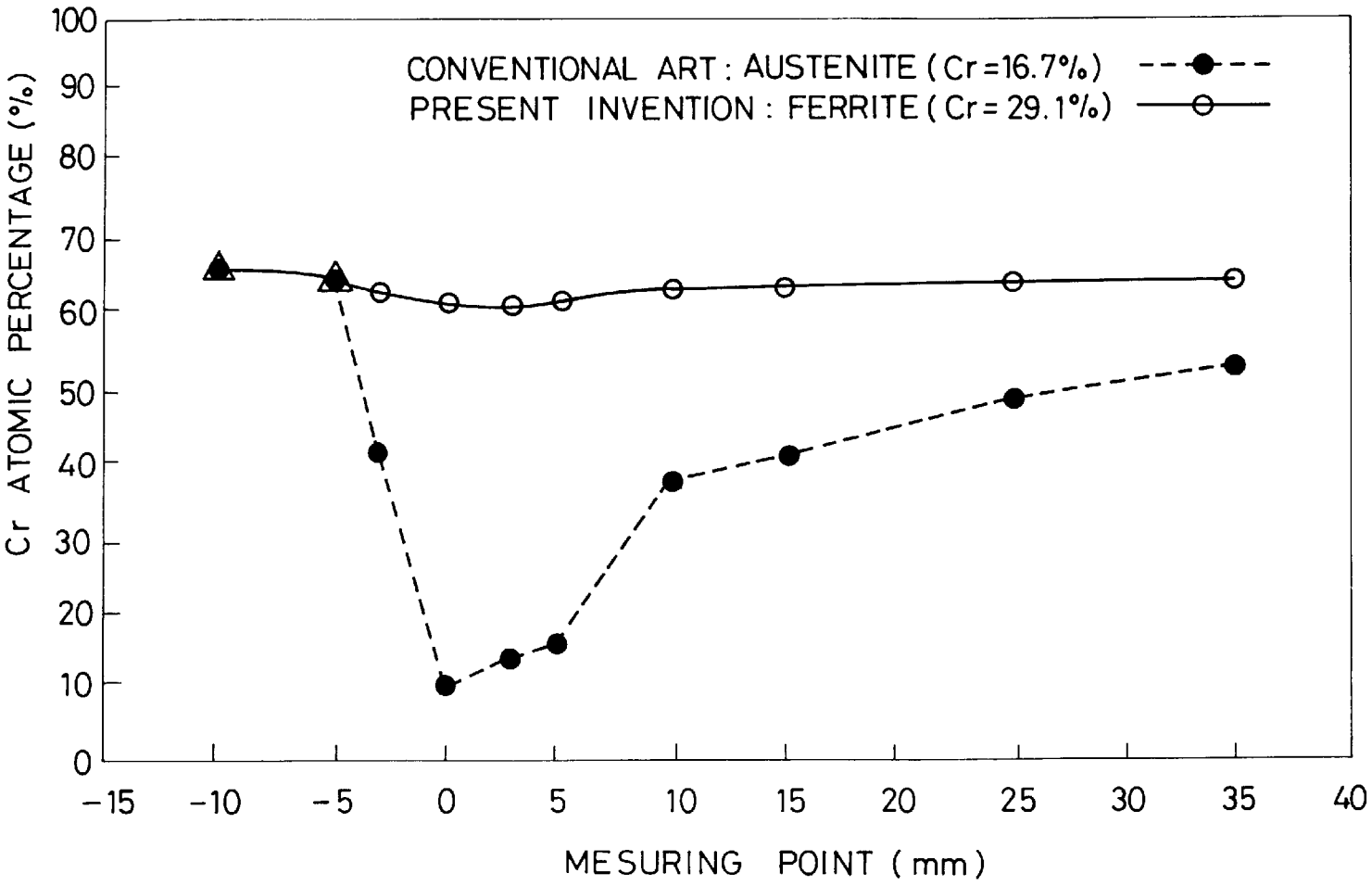
FIG. 4 is a graph showing a result of measurement by means of ESCA in which changes of composition of Cr after welding are shown (7.5 rpm×1 rev.)
Figure 5:
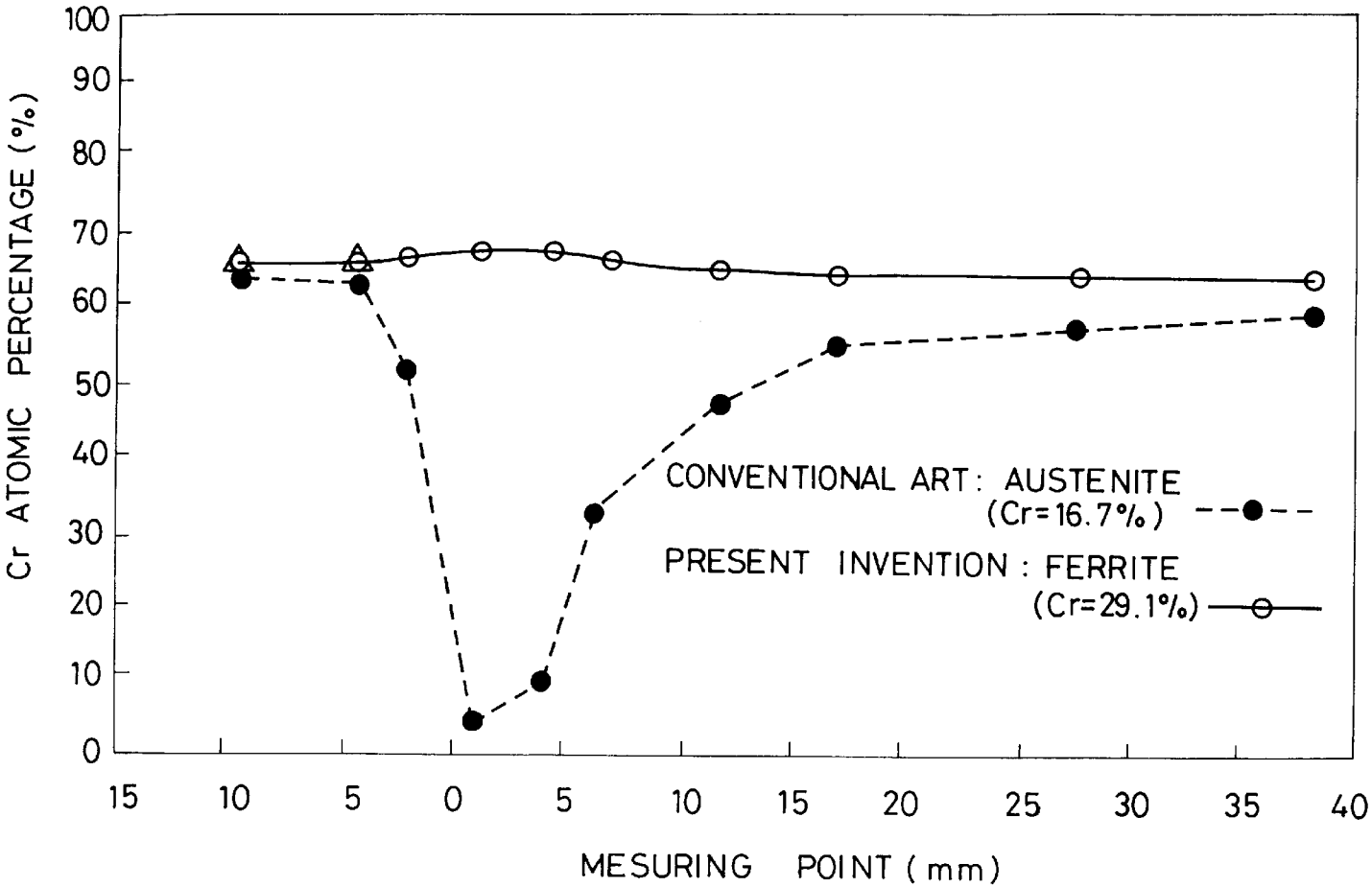
FIG. 5 is a graph showing a result of measurement by means of ESCA in which changes of composition of Cr after welding are shown (30 rpm×2 rev.).

FIG. 3 shows the result.

The dotted line in FIG. 3 indicates a result in which the conventional type of austenite system stainless steel was electrolytically polished, and the solid line therein indicates a result in which the ferrite system stainless steel was electrolytically polished and was subjected to a $Cr_2O_3$ processing. Conditions for the $Cr_2O_3$ passivation processing evaluated herein are equivalent to those described in Embodiment 1.

It can be said from the results shown in FIG. 3 that the surface of the ferrite-based stainless steel electrolytically polished which is subjected to the $Cr_2O_3$ processing is excellent in moisture desorption characteristics. In short, it is understood that a $Cr_2O_3$ passivated surface, which has a very small affected surface area, is extremely excellent in moisture desorption characteristics.

Also an experiment for corrosion resistance was carried out under conditions in which a sample and a hydrogen chloride gas containing 1000 ppm of moisture were introduced into a vessel, and were left at 50° C. for 14 days, and as a result, the stainless steel, according to the embodiment, on which a passivated film having a layer made of chromium oxide with a thickness of 15 nm on the outermost surface is formed, was found no sign of corrosion thereon.

INDUSTRIAL APPLICABILITY

With the present invention, it is possible to easily and quickly form an oxide-passivated film having a layer made of 100% chromium oxide with a thickness of not less than 15 nm on the surface thereof on the surface of stainless steel, which was impossible in the conventional technology. The stainless steel is free from metal contamination and has excellent electric discharge gas characteristics, noncatalytic property, and high corrosion resistance, and when, for instance, a piping system is constructed with this stainless steel, an ultra-high purity gas can be fed, and when a process apparatus is constructed therewith, an ultra-high purity gas atmosphere can be realized.

What is claimed is:

1. A method of forming an oxide-passivated film on ferrite-based stainless steel comprising the steps of:

electrolytically polishing a surface of the ferrite-based stainless steel;

baking the ferrite-based stainless steel in an inert gas so as to remove moisture from the surface of said stainless steel; and heat-treating the ferrite-based stainless steel in a temperature range of from 300° C. to 600° C. in a mixed gas atmosphere of an inert gas and 500 ppb to 2% of $H_2O$ gas, whereby an oxide passivated film having a layer made of chromium oxide free from Fe oxide on the outermost surface is formed.

2. A method of forming an oxide-passivated film on ferrite-based stainless steel according to claim 1 wherein the stainless steel is ferrite-based stainless steel containing Mn by not more than 0.03 wt %, S by not more than 0.001 wt % , Cu by not more than 0.05 wt %, C by not more than 0.01 wt %, and Al by not more than 0.01 wt %.

3. A method of forming an oxide passivated film on ferrite-based stainless steel according to claim 1, wherein said stainless steel is ferrite-based stainless steel containing Mn by not more than 0.03 wt %, S by not more than 0.001 wt % , Cu by not more than 0.05 wt %, C by not more than 0.01 wt %, and Al by not more than 0.01 wt %, and Ni within the range of approximately 1.0 to 5.0 wt %.

4. A method of forming an oxide passivated film on ferrite-based stainless steel according to claim 1, wherein hydrogen gas is furthermore added by not more than 10% to said mixed gas.

5. A method of forming an oxide-passivated film on ferrite-based stainless steel comprising the steps of:

electrolytically polishing a surface of the ferrite-based stainless steel;

baking the ferrite-based stainless steel in an inert gas so as to remove moisture from the surface of said stainless steel; and heat-treating the ferrite-based stainless steel in a temperature range of from 300° C. to 600° C. in a mixed gas atmosphere of an inert gas and 4 ppm to 1% of $H_2O$ gas, whereby an oxide passivated film having a layer made of chromium oxide free from Fe oxide on the outermost surface is formed.

6. A method of forming an oxide-passivated film on ferrite-based stainless steel according to claim 5 wherein said stainless steel is ferrite-based stainless steel containing Mn by not more than 0.03 wt %, S by not more than 0.001 wt % , Cu by not more than 0.05 wt %, C by not more than 0.01 wt %, and Al by not more than 0.01 wt %.

7. A method of forming an oxide passivated film on ferrite-based stainless steel according to claim 5, wherein said stainless steel is ferrite-based stainless steel containing Mn by not more than 0.03 wt %, S by not more than 0.001 wt % , Cu by not more than 0.05 wt %, C by not more than 0.01 wt %, and Al by not more than 0.01 wt %, and Ni within the range of approximately 1.0 to 5.0 wt %.

8. A method of forming an oxide passivated film on ferrite-based stainless steel according to claim 5, wherein hydrogen gas is furthermore added by not more than 10% to said mixed gas.

9. Ferrite-based stainless steel having an electrolytically polished surface, wherein an oxide-passivated film having a layer made of chromium oxide free from Fe oxide with a thickness of not less than 15 nm on the electrolytically polished surface.

10. Ferrite-based stainless steel according to claim 9 wherein said stainless steel is ferrite-based stainless steel containing Mn by not more than 0.03 wt %, S by not more than 0.001 wt %, Cu by not more than 0.05 wt %, C by not more than 0.01 wt %, and Al by not more than 0.01 wt %.

11. Ferrite-based stainless steel according to claim 9, wherein said stainless steel is ferrite-based stainless steel containing Mn by not more than 0.03 wt %, S by not more than 0.001 wt %, Cu by not more than 0.05 wt %, C by not more than 0.01 wt %, and Al by not more than 0.01 wt %, and Ni by 1.0 to 5.0 wt %.

12. A method of forming an oxide passivated film on ferrite-based stainless steel according to claim 2, wherein hydrogen gas is furthermore added by not more than 10% to said mixed gas.

13. A method of forming an oxide passivated film on ferrite-based stainless steel according to claim 3, wherein hydrogen gas is furthermore added by not more than 10% to said mixed gas.

14. A method of forming an oxide passivated film on ferrite-based stainless steel according to claim 6, wherein hydrogen gas is furthermore added by not more than 10% to said mixed gas.

15. A fluid feed piping system constructed by welding pipings made of a ferrite-based stainless steel having an electrolytically polished surface, wherein an oxide-passivated film having a layer made of chromium oxide free from Fe oxide with a thickness of not less than 15 nm on the electrolytically polished surface.

16. A fluid feed piping system according to claim 15, wherein said stainless steel is ferrite-based stainless steel containing Mn by not more than 0.03 wt %, S by not more than 0.001 wt %, Cu by not more than 0.05 wt %, C by not more than 0.01 wt %, and Al by not more than 0.01 wt %.

17. A fluid feed piping system according to claim 15, wherein said stainless steel is ferrite-based stainless steel containing Mn by not more than 0.03 wt %, S by not more than 0.001 wt %, Cu by not more than 0.05 wt %, C by not more than 0.01 wt %, and Al by not more than 0.01 wt % and Ni by 1.0 to 5.0 wt %.

18. A process apparatus is constructed with a ferrite-based stainless steel having an electrolytically polished surface, wherein an oxide-passivated film having a layer made of chromium oxide free from Fe oxide with a thickness of not less than 15 nm on the electrolytically polished surface.

19. A process apparatus according to claim 18, wherein said stainless steel is ferrite-based stainless steel containing Mn by not more than 0.03 wt %, S by not more than 0.001 wt %, Cu by not more than 0.05 wt %, C by not more than 0.01 wt %, and Al by not more than 0.01 wt %.

20. A process apparatus according to claim 18, wherein said stainless steel is ferrite-based stainless steel containing Mn by not more than 0.03 wt %, S by not more than 0.001 wt %, Cu by not more than 0.05 wt %, C by not more than 0.01 wt %, and Al by not more than 0.01 wt %, and Ni by 1.0 to 50 wt %.

21. A fluid contact component made of a ferrite-based stainless steel having an electrolytically polished surface, wherein an oxide-passivated film having a layer made of chromium oxide free from Fe oxide with a thickness of not less than 15 nm on the electrolytically polished surface.

22. A fluid contact component according to claim 21, wherein said stainless steel is ferrite-based stainless steel containing Mn by not more than 0.03 wt %, S by not more than 0.001 wt %, Cu by not more than 0.05 wt %, C by not more than 0.01 wt %, and Al by not more than 0.01 wt %.

23. A fluid contact component according to claim 21, wherein said stainless steel is ferrite-based stainless steel containing Mn by not more than 0.03 wt %, S by not more than 0.001 wt %, Cu by not more than 0.05 wt %, C by not more than 0.01 wt %, and Al by not more than 0.01 wt %, and Ni by 1.0 to 5.0 wt %.

* * * * *

UNITED STATES PATENT AND TRADEMARK OFFICE

CERTIFICATE OF CORRECTION

PATENT NO. : 5,951,787

DATED : September 14, 1999

INVENTOR(S) : Tadahiro Ohmi, et al

It is certified that error appears in the above-identified patent and that said Letters Patent is hereby corrected as shown below:

On the title page: Item [75] "Sendai, Migaya-Ken" should read --Sendai-shi, Miyagi- ken --.

Column 1, line 24, "efforts has" should read --efforts have --.

Column 2, line 3,"of impurities" should read --impurities --.

Signed and Sealed this

Nineteenth Day of December, 2000

*Attest:*

Q. TODD DICKINSON

*Attesting Officer*

*Commissioner of Patents and Trademarks*